US005257506A

United States Patent [19]

DeWolf et al.

[11] Patent Number: 5,257,506

[45] Date of Patent: Nov. 2, 1993

[54] DEFROST CONTROL

[75] Inventors: Thomas L. DeWolf, Liverpool; Thomas R. Phillips; Ronald W. Bench, both of Cicero, all of N.Y.

[73] Assignee: Carrier Corporation, Syracuse, N.Y.

[21] Appl. No.: 673,448

[22] Filed: Mar. 22, 1991

[51] Int. Cl.[5] ..... F25B 41/00

[52] U.S. Cl. ..... 62/80; 62/155; 62/156

[58] Field of Search ..... 62/81, 154, 155, 156, 62/234

[56] References Cited

U.S. PATENT DOCUMENTS

| | | | |
|---|---|---|---|
| 4,299,095 | 11/1981 | Cassarino | 62/156 X |
| 4,373,349 | 2/1983 | Mueller | 62/155 X |
| 4,590,771 | 5/1986 | Shaffer et al. | 62/155 X |
| 4,882,908 | 11/1989 | White | 62/234 X |

*Primary Examiner*—Harry B. Tanner

[57] ABSTRACT

A defrost cycle for a heat pump system which optimizes the efficiency of the heat pump by initiating defrost depending upon the relationship of both the outdoor coil ambient temperature and the outdoor coil refrigerant temperature with a predetermined temperature reference level.

11 Claims, 3 Drawing Sheets

DEFROST CONTROL

BACKGROUND OF THE INVENTION

1. Field of the Invention

This invention relates generally to heat pump systems, and more particularly to an apparatus and a method for controlling a defrost cycle for effecting defrost of an outdoor heat exchanger coil by initiating a defrost cycle as a function of outdoor coil temperature and outdoor air temperature.

2. Prior Art

Air conditioners, refrigerators and heat pumps produce a controlled heat transfer by the evaporation in a heat exchanger of a liquid refrigerant under appropriate pressure conditions to produce desired evaporator temperatures. Liquid refrigerant removes its latent heat of vaporization from the medium being cooled and in this process is converted into a vapor at the same pressure and temperature. This vapor is then conveyed into a compressor wherein its temperature and pressure are increased. The vapor then is conducted to a separate heat exchanger serving as a condenser wherein the gaseous refrigerant absorbs its heat of condensation from a heat transfer fluid in heat exchange relation therewith and changes state from a gas to a liquid. The liquid is supplied to the evaporator after flowing through an expansion device which acts to reduce the pressure of the liquid refrigerant such that the liquid refrigerant may evaporate within the evaporator to absorb its heat of vaporization and complete the cycle.

During the heating mode, a heat pump circuit utilizes an outdoor heat exchanger serving as an evaporator wherein the evaporator may be located in ambient air at a temperature below the freezing point of water. Thus, as this cold ambient air is circulated over the heat exchanger, water vapor in the air is condensed and frozen on the surfaces of the heat exchanger. As the frost accumulates on the heat exchanger a layer of ice is built up between the portion of the heat exchanger carrying refrigerant and the air flowing thereover. This layer of ice acts as an insulating layer inhibiting the heat transfer in the coil between refrigerant and air. Additionally, the ice may serve to block narrow air flow passageways between fins utilized to enhance heat transfer. This additional effect further serves to reduce heat transfer since lesser amounts of air will be circulated in heat exchanger relation with the refrigerant carrying conduits.

To efficiently operate a heat pump in relatively low outdoor ambient air conditions it is necessary to provide apparatus for removing the accumulated frost. Many conventional methods are known such as supplying electric resistance heat, reversing the heat pump such that the evaporator becomes a condenser or other refrigerant circuiting techniques to direct hot gaseous refrigerant directly to the frosted heat exchanger.

Many of these defrost techniques utilize energy that is not effectively used for transferring heat energy to a space to be conditioned or to another end use served by the entire system. To reduce the amount of heat energy wasted or otherwise consumed in the defrost operation it is desirable to utilize a defrost system which places the refrigeration circuit in the defrost mode only when it is determined that too much frost has accumulated on the outdoor coil.

Different types of control systems have been utilized for initiating defrost. A combination of a timer and a thermostat may be used to determine when to initiate defrost. The thermostat periodically checks to see whether or not the outdoor refrigerant temperature or a temperature dependent thereon is below a selected level, and if so acts to place the system in defrost for a length of time dependent on the timer. Other types of prior art defrost initiation systems have included measuring infrared radiation emitted from the fins of the refrigerant carrying coil, measuring the air pressure differentials of the air flow flowing through the heat exchanger, measuring the temperature difference between the coil and the ambient air, utilizing an electrical device placed on the fin whose characteristics change depending on the temperature of the device, optical-electrical methods and other methods involving the monitoring of various electrical parameters.

A disadvantage of the prior defrost modes is that they are generally static systems, wherein the initiation of the defrost mode is fixed solely by the refrigerant temperature of the coil. These static systems cause efficiency degradation since defrost is not initiated at an appropriate time, and as a function of outdoor air temperature and compressor run time.

Thus, there is a clear need for a defrost system that adjusts the initiation of defrost in response to environmental conditions to optimize defrost.

SUMMARY OF THE INVENTION

It is an object of the present invention to provide an improved defrost control for use with a refrigeration circuit.

It is a further object of the present invention to provide a method of determining when to initiate defrost for an air conditioning or a refrigeration circuit.

It is a further object of the present invention to provide defrost control method which maximizes the efficiency of a complete cycle of operation.

It is another object of the present invention to provide a method and apparatus of utilizing the defrost mode only when the heat pump is operated within a frost accumulation limit.

In accordance with the present invention, these and other objects are attained by a method and apparatus for measuring the amount of frost accumulated on the outdoor coil of a heat pump system and initiating defrost when a predetermined amount of frost has accumulated, and terminating defrost when the outdoor coil reaches a desired temperature.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification, and in which reference numerals shown in the drawings designate like or corresponding parts throughout the same, and in which.

DESCRIPTION OF THE PREFERRED EMBODIMENT

Figure 1:
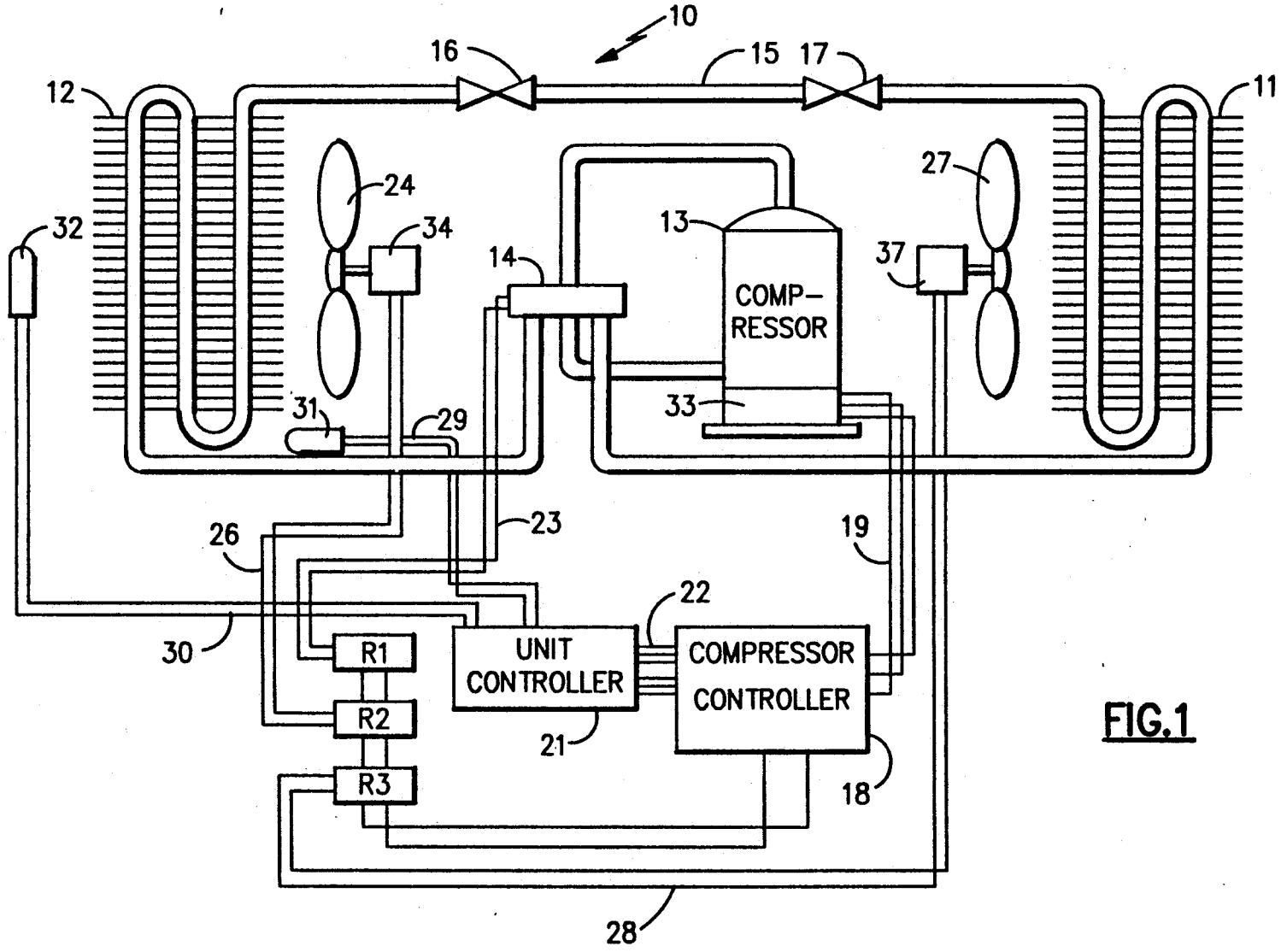
FIG. 1 is a schematic illustration of a heat pump system having the present invention incorporated therein.

Referring now to FIG. 1, there is shown a heat pump system 10 comprising an indoor coil 11, and outdoor coil 12, a compressor 13 and a reversing valve 14. Installed in the line 15 between the indoor and outdoor coils 11 and 12, are expansion valves 16 and 17 with each having provision for bypassing refrigerant when it is not acting as an expansion device. All of these components operate in a rather conventional heat pump manner to provide cooling to the indoor space while operating in the air conditioning mode and heating to the indoor space while operating in a heating mode.

Although the present invention is equally applicable to either constant speed or variable speed systems, it will presently be described with reference to a constant speed system. Such a system contemplates the use of multi-speed motors such as, for example, a two speed compressor motor. The motor 33 drives the compressor 13, which is normally located in the outdoor section near the outdoor coil 12, the motor 37 drives the fan 27 for the indoor coil 11, and the motor 34 drives the outdoor fan 24. A compressor controller 18 is therefore provided to communicate with and to coordinate the operation of the compressor and its associated equipment.

The controller 18 is electrically connected to the compressor motor 33 by leads 19 and to a unit controller 21 by leads 22. The unit controller is, in turn, connected to; reversing valve 14 by a way of relay R1 and leads 23; the outdoor coil fan motor 34 by way of relay R2 and leads 26; and to the indoor coil fan motor 37 by way of relay R3 and leads 28. In addition, the unit controller 21 is electrically connected to an outdoor coil thermistor 31 by way of leads 29 and outdoor ambient air thermistor 32 by way of leads 30. Further, the unit controller 21 accumulates compressor run time and time between defrosts.

The present invention is intended to optimize the efficiency of the defrost cycle by initiating the defrost cycle in accordance with outdoor air temperature and outdoor coil temperature, a function of compressor run time and, as a function of the previous defrost to thereby maintain an optimum initiation time defrost. In doing so, the operational parameters that are measured are outdoor coil temperature, which is measured both before and after the defrost cycle by a thermistor 31, to provide an indication of refrigeration temperature, outdoor ambient air temperature, which is continuously measured by a thermistor 32 to provide an indication of outdoor air temperature, compressor and accumulated run time, both continuous run time and time between defrost.

Figure 2:
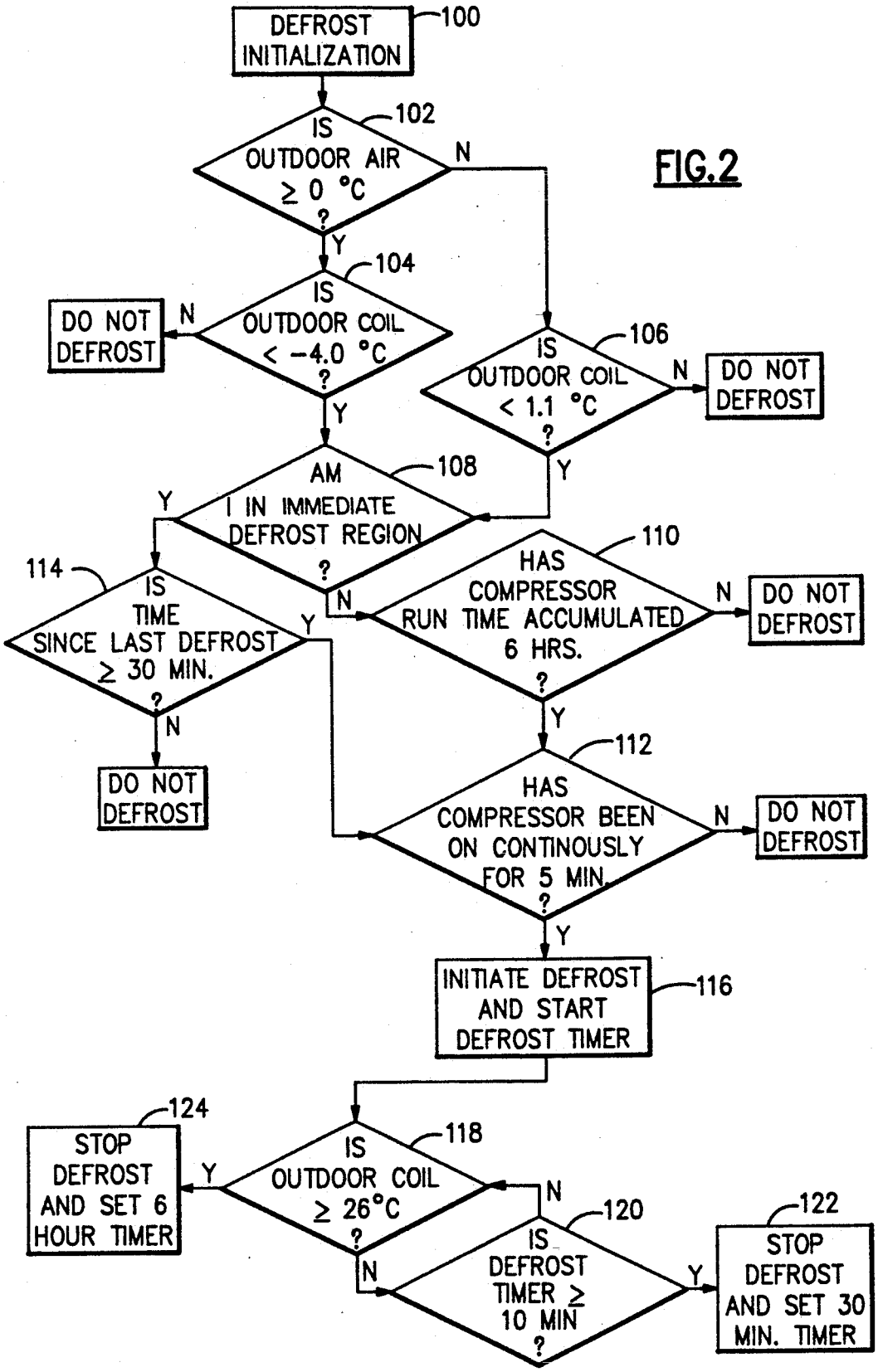
FIG. 2 is a flow diagram showing the sequence of steps to be performed in carrying out the present invention.

FIG. 2 shows the flow chart of the logic used to determine the time-to-initiate-defrost and the time-to-terminate-defrost in accordance with the present invention. The flow chart includes defrost initialization 100 from which the logic flows to step 102 to determine whether the outdoor air temperature is greater than or equal to 0° C. If the answer is YES, the logic proceeds to step 104 to determine whether the outdoor coil temperature is less than −4.0° C. If the answer to step 104 is NO, then defrost is not initiated. If the answer to step 102 is NO, the logic flows to step 106 to determine whether the outdoor coil temperature is less than 1.1° C. If the answer to step 106 is NO, then defrost is not initiated, but if the answer is YES the logic flows to step 108 to determine whether the coil is in the Immediate Defrost Region regarding FIG. 3. If the answer to this step is NO, then the coil must be in the time defrost Region and the logic flows to step 110 to determine whether the accumulated compressor run time is greater than 6 hours. If the compressor has not accumulated 6 hours or more of run time then defrost is not initiated. However, if the compressor has accumulated 6 hours or more of run time the logic flows to step 112 which determines whether the compressor has been ON for 5 continuous minutes. If the compressor had just started but has not been continuously running for 5 minutes, even though the total non-continuous run time may be greater than 6 hours, then the logic would not initiate defrost. However, if the compressor had been running continuously for 5 minutes then defrost would be initiated and the defrost timer would be started in step 116.

In step 108 if the parameters determine that the system is in the Immediate Defrost Region then the logic proceeds to step 114. At step 114 the time since the last defrost is compared to the fixed time for defrost of 30 minutes, and if the the compressor run time since last defrost is equal to or greater than the 30 minute time the logic again proceeds to step 112 and controls defrost as set forth above. If the answer to step 114 is NO, then the logic does not initiate defrost.

After the logic has flowed through 112 to initiate defrost in step 116 it then proceeds to step 118 to determine whether the outdoor coil temperature is equal to or greater than 26° C. If the answer is NO, the logic flows to step 120 to determine whether the defrost timer is equal to or greater than 10 minutes. If the answer in step 120 is NO, the logic proceeds back to step 118 while defrost continues. If the answer in step 120 is YES, the logic proceeds to step 122 to terminate defrost and resets 30 minute defrost timer to equal to zero. At step 118 if the answer is YES, the logic flows to step 124 wherein defrost is terminated, the defrost timer is stopped, and the six hour compressor run timer is reset to zero.

Figure 3:
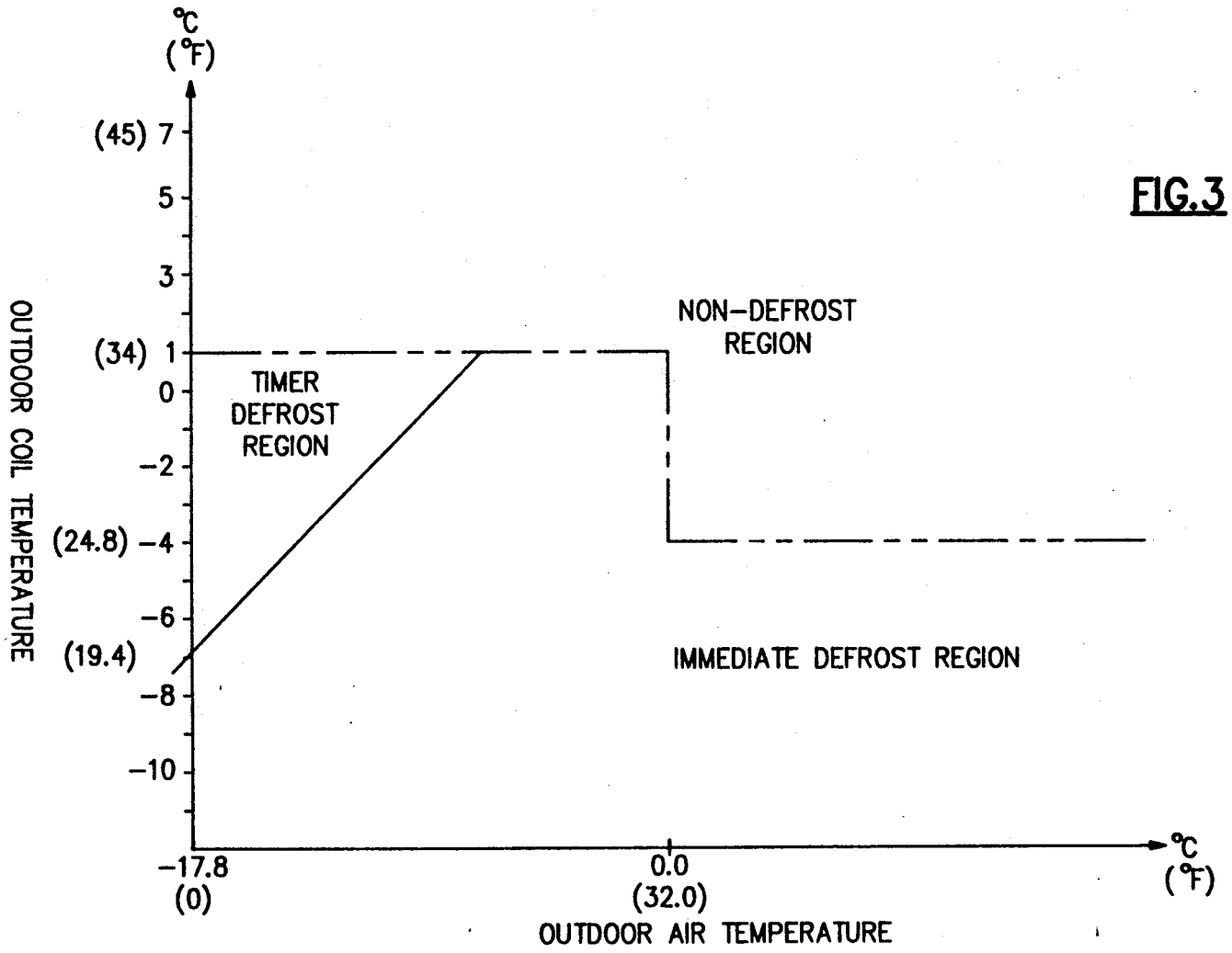
FIG. 3 is a graphic illustration of an envelope plotted as a function of outdoor ambient air temperature and the temperature and the outdoor coil temperature.

Defrost is regulated generally as shown in FIG. 3. The defrost region is shown as a function of outdoor coil temperature and outdoor air temperature. Defrost is only initiated when operating in the heating mode and when the temperature parameters are either in the Time Defrost Region or the Immediate Defrost Region. Defrost will not be initiated if the outdoor coil temperature is greater than 34° F. (+1.1° C.) and the outdoor air temperature is less than 32° F. (0.0° C.), or if the outdoor coil temperature is greater than 24.8° F. (−4.0° C.) and the outdoor air temperature is greater than 32° F. (0.0° C.), which is the Region. If the coil temperature is above the reference level curve "A", (The Timer Defrost Region), defrost automatically occurs after six (6) hours of compressor run time but if the coil temperature is below curve "A", the coil is immediately defrosted if the compressor has been running for thirty (30) minutes since the last defrost. The reference level curve "A" as determined by empirical data is expressed as: Outdoor Coil Temperature ($T_c$) (° F.)=4/5 Outdoor Air Temperature ($T_o$) (° F.)+ordinate intercept, where the ordinate intercept is 19.4° F. (−7.0° C.).

While the invention has been described in detail with reference to the illustrative embodiments, many modifications and variations would present themselves to those skilled in the art.

What is claimed is:

1. A method of controlling when to initiate a defrost cycle to remove accumulated frost from an outdoor heat exchanger coil forming a portion of a refrigerant heat pump system including a compressor, said method comprising the steps of:

sensing a value of ambient temperature of the outdoor heat exchanger;

sensing the temperature value of the refrigerant in the outdoor heat exchanger;

defining a two dimensional coordinate system wherein a first coordinate corresponds to ambient temperature of the outdoor heat exchanger and wherein a second coordinate corresponds to the refrigerant temperature in the outdoor heat exchanger;

defining regions of points having coordinate values relative to the two dimensional coordinate system, the regions including a first region of points wherein a first conditionally activated defrost action is to occur and a second region wherein a second conditionally activated defrost action is to occur, and a third region wherein no defrost action is to occur;

defining a particular point in space relative to the two dimensional coordinate system, the point having a first coordinate value corresponding to the sensed value of ambient temperature of the outdoor heat exchanger and a second coordinate value corresponding to the sensed value of the refrigerant temperature in the outdoor heat exchanger;

determining whether the particular point in space lies within the first, second or third regions; and implementing a first conditionally activated defrost action if the point lies in the first region and implementing a second conditionally activated defrost action if the point lies in the second region.

2. The method of claim 1 wherein the first conditionally activated defrost action comprises the steps of:

examining whether the accumulated run time of the compressor has exceeded a predetermined number of hours;

determining whether the compressor has been currently running continuously for a first predetermined period of time if the predetermined number of hours of accumulated run time has been exceeded; and initiating a defrost cycle only if the first predetermined period of time has been exceeded.

3. The method of claim 2 wherein the first region consists of all points having coordinate values corresponding to sensed outdoor ambient temperatures that are less than one and one tenth degree Centigrade while at the same time being greater than the following:

$$T_o = -7 + 0.8\ T_a,$$

wherein $T_o$ is the minimum outdoor temperature in degrees Centigrade for a corresponding sensed outdoor ambient temperature, $T_a$.

4. The method of claim 2 wherein the predetermined period of time of the compressor continuously running is at least five minutes.

5. The method of claim 2 further comprising the step of:

terminating any defrost cycle when the temperature of the refrigerant in the outdoor heat exchanger is equal to or greater than twenty six degrees Centigrade.

6. The method of claim 2 wherein the second conditionally activated defrost action comprises the steps of:

examining whether a second predetermined period of time has elapsed since the last defrost cycle;

determining whether the compressor has been currently running continuously for the first predetermined period of time if the second predetermined period of time has elapsed since the last defrost cycle; and initiating a defrost cycle only if the first predetermined period of time has been exceeded.

7. The method of claim 6 wherein the second predetermined period of time that has elapsed since the last defrost cycle is thirty minutes.

8. The method of claim 6 wherein the first predetermined period of time of the compressor continuously running is at least five minutes.

9. The method of claim 6 further comprising the step of:

terminating any defrost cycle when the temperature of the refrigerant in the outdoor heat exchanger is equal to or greater than twenty six degrees centigrade.

10. The method of claim 1 wherein the third region consists of all points having coordinate values corresponding to sensed outdoor refrigerant temperatures above one and one tenth degree Centigrade when the coordinate values for corresponding sensed outdoor ambient air temperature is below zero degrees Centigrade and all points having coordinate values corresponding to sensed outdoor refrigerant temperatures above minus four degrees Centigrade when the coordinate values for corresponding sensed outdoor ambient air temperature is above zero degrees Centigrade.

11. The method of claim 1 wherein the first region consists of all points having coordinate values corresponding to sensed outdoor ambient temperatures that are less than one and one tenth degree Centigrade while at the same time being greater than the following:

$$T_o = -7 + 0.8\ T_a,$$

wherein $T_o$ is the minimum outdoor temperature in degrees Centigrade for a corresponding sensed outdoor ambient temperature, $T_a$.

* * * * *